US005255909A

United States Patent [19]

Wendell

[11] Patent Number: 5,255,909

[45] Date of Patent: Oct. 26, 1993

[54] BASKETBALL'S PORTABLE BASE

[75] Inventor: Edward O. Wendell, 728 58th St., Oakland, Calif. 94609

[73] Assignee: Edward O. Wendell, Oakland, Calif.

[21] Appl. No.: 892,323

[22] Filed: Jun. 2, 1992

[51] Int. Cl.[5] ..... A63B 63/08

[52] U.S. Cl. ..... 273/1.5 R; 108/51.1

[58] Field of Search ..... 273/1.5 R, 1.5 A, 407; 108/51.1, 55.1, 55.3

[56] References Cited

U.S. PATENT DOCUMENTS

| | | | |
|---|---|---|---|
| 2,738,058 | 3/1956 | Hansen et al. | 108/55.1 X |
| 2,765,137 | 10/1956 | Tatko | 108/55.1 |
| 3,285,204 | 11/1966 | Schweitzer, Jr. | 108/55.3 |
| 3,327,889 | 6/1967 | Dore | 108/55.1 X |
| 3,414,262 | 12/1968 | Lounsbury | 273/1.5 R |
| 4,911,084 | 3/1990 | Sato et al. | 108/55.1 |
| 5,100,132 | 3/1992 | Anderson et al. | 273/1.5 R |

FOREIGN PATENT DOCUMENTS

| | | | |
|---|---|---|---|
| 460223 | 3/1975 | U.S.S.R. | 108/55.1 |
| 636440 | 4/1950 | United Kingdom | 108/55.1 |

*Primary Examiner*—Paul E. Shapiro

[57] ABSTRACT

Basketballs portable base has been especially designed to accommodate forklifts.

The base provides for backboard support and a lip along the top's front side for backboard mounting purposes.

1 Claim, 2 Drawing Sheets

BASKETBALL'S PORTABLE BASE

BACKGROUND OF THE INVENTION

An object of the present invention is to provide for forklifts a portable base that accommodates basketball backboards.

SUMMARY OF THE INVENTION

The present invention, a portable base for basketball backboards, has been especially designed for warehouses.

The intention of the present invention is to relieve stress by way of exercise while boosting employee morale.

Warehouse management has long sought ways to show employee appreciation. Versatility is the key. Unlike basketballs traditional stationary backboards, portable backboards are designed especially for forklifts. They are mobile. They don't get in the way of warehouse storages and they are easy to maintain.

DESCRIPTION OF THE PREFERRED EMBODIMENT

Figure 1:
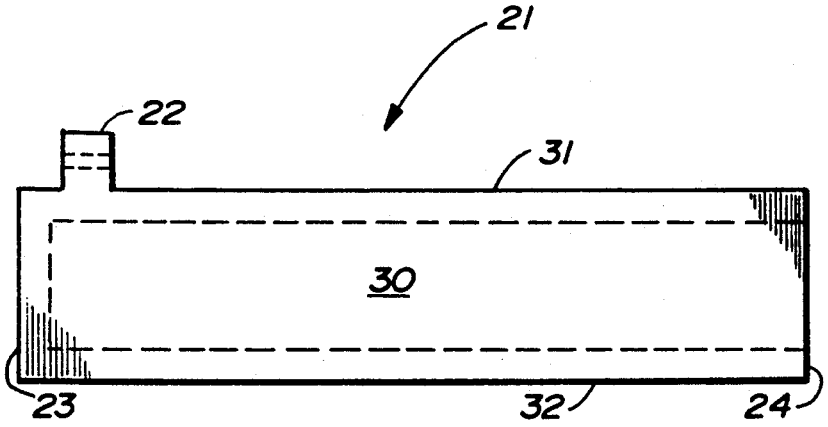
FIG. 1 shows a side view of basketballs portable base.

FIG. 1. Referring to the drawing, numeral #21 designates the base; #22 designates the lip for backboard mounting purposes; #23 front of base; #24 slots for forklift blades in back of base; #30 the sides; #31 the top; #32 the bottom.

Figure 2:
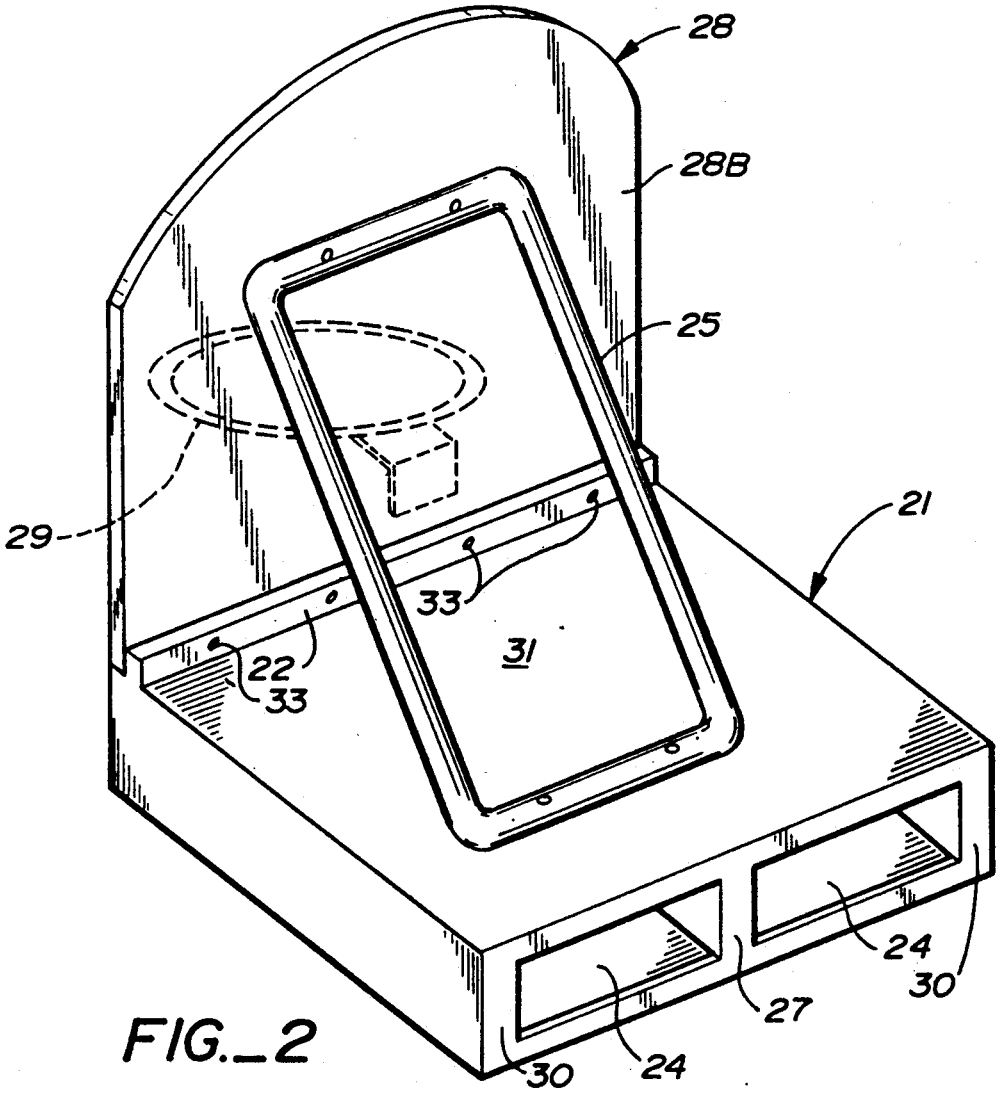
FIG. 2 shows a perspective view of the device.

FIG. 2 shows #21 the base; #22 the lip for backboard mounting purposes; #24 slots for forklift blades in back of base; #25 a support; #27 a middle support in base;

#28 and 28B a backboard; #29 a rim #30 the sides; #31 the top; #33 backboard mounting holes in lip.

Figure 3:
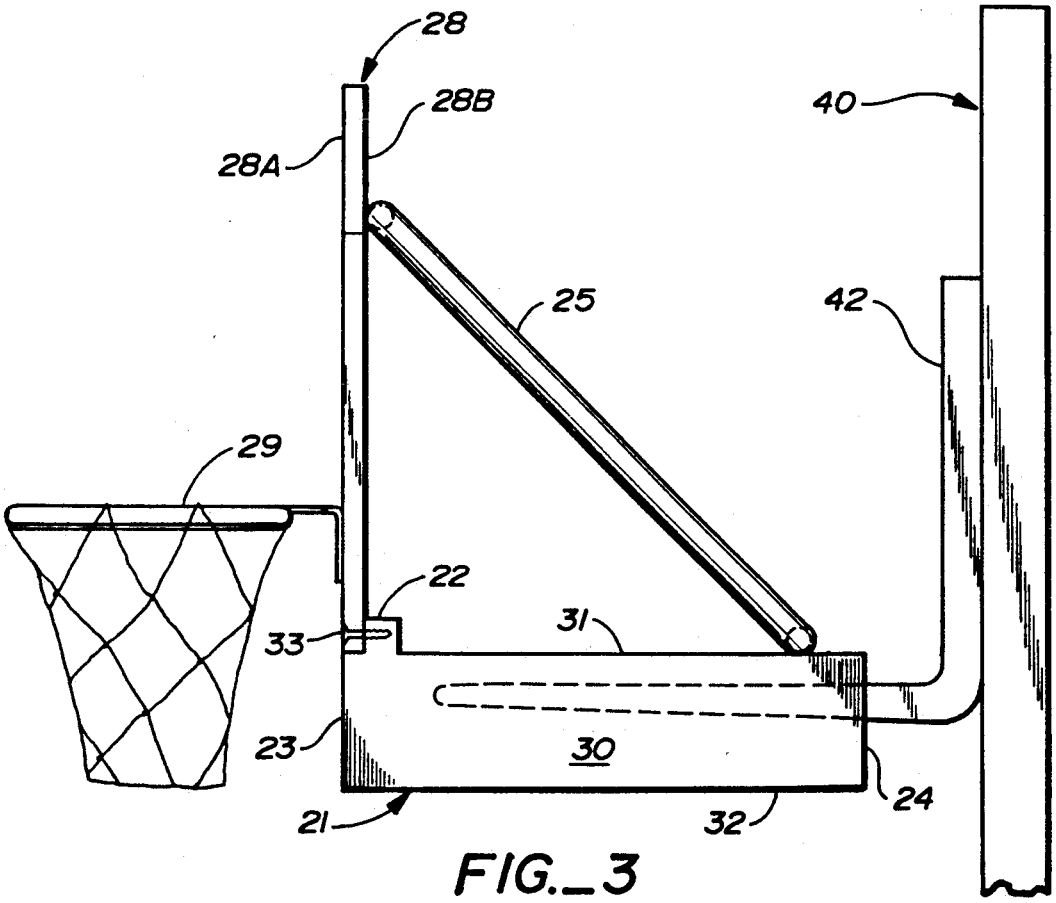
FIG. 3 shows a side view of the base complete with forklift.

FIG. 3 shows #21 the base; #22 the lip for backboard mounting purposes; #23 front of base; #24 slots for forklift blades in back of base; #25 a support; #28, 28A and 28B a backboard; #29 a basketball's rim and net; #30 the sides; #31 the top; #32 the bottom; #33 backboard mounting holes in lip; #40 forklift; #42 forklift blades.

What is claimed:

1. A portable basketball apparatus comprising:

A. A base having 1. a horizontal top surface having a front, a back and two side edges;
2. a horizontal bottom surface spaced from and co-extensive with said top surface;
3. a plurality of longitudinal spacer members extending vertically between said top and bottom surfaces, one of said spacer members extending from front to back adjacent each side edge of the top member and a third spacer member extending from front to back centrally between the side edges of said top member thereby defining at least two longitudinally extending channels between the top and bottom surfaces into which the tines of a lift fork may be inserted;
4. a lip secured to the top surface, said lip being positioned rearwardly from said front edge of said top surface, and extending upwardly therefrom;

B. a basketball backboard having front and rear surfaces extending upwardly from and having a lower edge secured to said lip;

C. a diagonal brace secured to the rear surface of said backboard above said lip and to said top surface rearwardly of said lip; and D. a basketball hoop secured to said backboard front surface and extending forwardly therefrom.

* * * * *